United States Patent [19]

Hill et al.

[11] Patent Number: 4,701,735

[45] Date of Patent: Oct. 20, 1987

[54] BOBBINS FOR ELECTRICAL COILS AND METHOD OF MANUFACTURING ELECTRICAL COILS THEREFROM

[75] Inventors: John Hill, Cincinnati, Ohio; Royston W. Bannister; Henry Turczanski, both of Kent, England

[73] Assignee: Standex Electronics (U.K.) Limited, Kent, England

[21] Appl. No.: 940,608

[22] Filed: Dec. 11, 1986

[51] Int. Cl.[4] ..... H01F 5/00

[52] U.S. Cl. ..... 335/282; 335/299; 336/205; 336/208

[58] Field of Search ..... 335/151, 282, 299; 336/199, 205, 207, 208

[56] References Cited

U.S. PATENT DOCUMENTS

| | | | |
|---|---|---|---|
| 3,661,342 | 5/1972 | Seans | 336/208 X |
| 3,939,450 | 2/1976 | Donnelly | 336/208 X |
| 4,308,784 | 4/1983 | Hill et al. | 335/151 |
| 4,595,901 | 6/1986 | Yahagi | 336/208 X |

*Primary Examiner*—George Harris
*Attorney, Agent, or Firm*—Weingarten, Schurgin, Gagnebin & Hayes

[57] ABSTRACT

A symmetrical bobbin especially adapted for the automatic manufacture of electrical coils. The bobbin, formed of high-strength plastic material, comprises first and second lips formed at terminal ends thereof and first and second flanges spaced inwardly from the lips. The bobbin surface between the flanges defines a main coil winding space and the bobbin surfaces between the lips and corresponding flanges define first and second terminal winding spaces. Immersion soldered terminal connections, of high physical strength, durability and electrical conductivity, are formed by extensibly wrapping electrical wire from the main coil about the terminal winding spaces and subsequently immersing the wire-wound terminal winding spaces in molten solder to provide a circumferential bond of unitary structure for terminal connection.

12 Claims, 5 Drawing Figures

FIG. 1
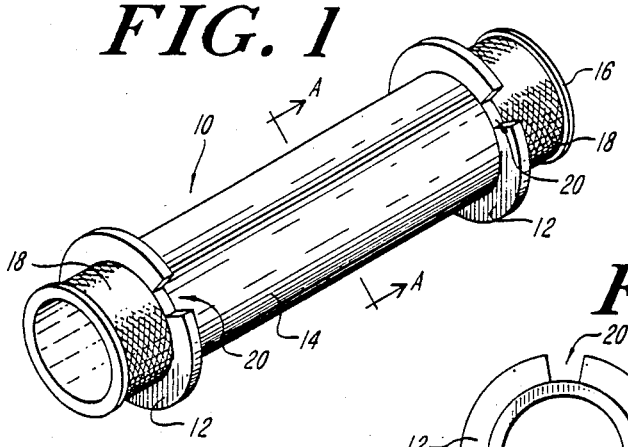
FIG. 2A
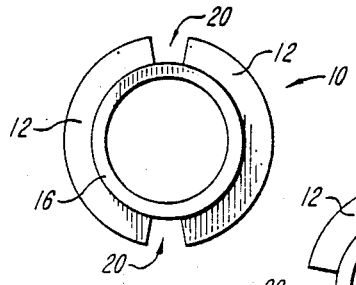
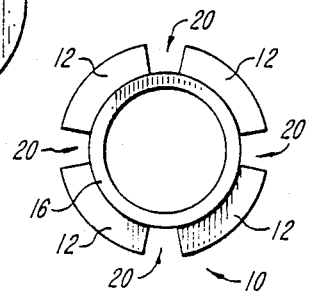
FIG. 2B
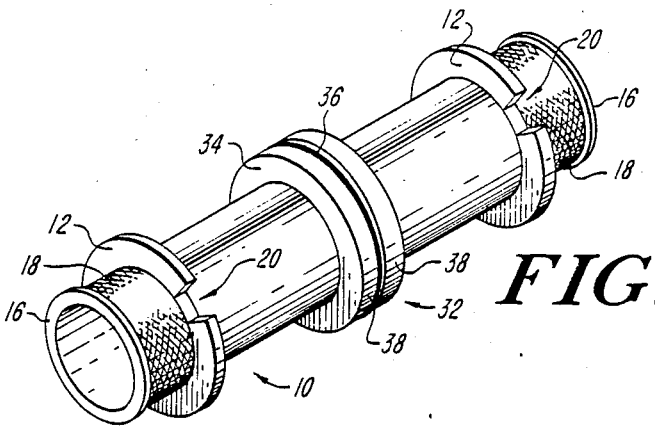
FIG. 4
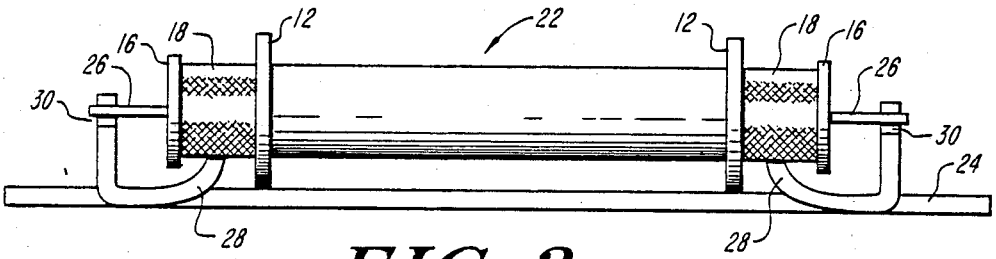
FIG. 3

BOBBINS FOR ELECTRICAL COILS AND METHOD OF MANUFACTURING ELECTRICAL COILS THEREFROM

FIELD OF THE INVENTION

The present invention relates to bobbins for electrical coils, and more particularly, to a symmetrical high strength plastic bobbin which readily facilitates the formation of strong terminal connections for a main coil formed thereon, and field for description do not yet describe the invention.

BACKGROUND OF THE INVENTION

Electrical coils formed on integral or tubular core bobbins are well known in the prior art, such bobbins having terminating flanges or cheeks at each end thereof to define a main wire-winding space. The terminal connections for such prior art electrical coils are formed by running wire from the main coil through the flanges to posts on each end of the bobbin, wrapping several turns of wire around the posts, anchoring the wire wound on the posts by soldering, and then severing any remaining wire from the posts.

Fabrication of the terminal connections of these prior art bobbins is cumbersome and time consuming, requiring manual handling to wire the posts and to subsequently solder the wound wire together. Breakage of wire, especially in miniature bobbins utilizing hair-like wire, is another problem prevalent in in these prior art bobbins.

A further problem with the prior art bobbins is that the terminal connections thereof are structurally weak. Such terminal connections are unsuitable for manufacturing applications which exert large stresses on the terminal connections, the large stresses often causing fractures and/or breakage.

A bobbin of unitary construction which overcomes these disadvantages, is described in U.S. Pat. No. 4,380,748 of the present assignee. The '748 patent shows a bobbin of unitary construction having a main winding space for winding electrical wire to form the electrical coil, and at least one further winding space separate from the main winding space for terminating the wire wound on the main winding, thereby forming a terminal connection for the electrical coil. The winding space comprises a tubular winding core defined by spaced apart end cheeks.

The winding core has formed therein a notched annular groove. A cut-out is formed in the tubular winding core, which exposes the hollow core of the winding space and which also forms gaps or breeches in the groove. As wire is wound on the winding space, the gaps in the winding space are bridged by the wound wire to form an unsupported bridging portion, the unsupported wire bridging portion comprising the terminal connection. The wire strands at the bridging portion is soldered together to form terminal connections for the coil wound on the main winding space. The gaps in the winding space ensure that the bobbin is not deleteriously affected by the soldering operation.

While the bobbin described in the '748 patent provides terminals that can be wound and soldered by automated procedures, it will be appreciated that the wire on the winding space which forms the bridging portion thereof is not supported physically, but rather is suspended, and therefore exposed to possible damage during soldering or further handling of the bobbin.

Thus, while the invention of the '748 patent provides relatively tough and strong terminal connections, the unsupported bridging wire portions forming the terminal connection are structurally weak, which limits the strength and durability of the terminal connections of the electrical coil. In addition, the soldering connection is localized at the bridging portion of the winding space.

SUMMARY OF THE INVENTION

The present invention provides an improvement over the bobbin of the '748 patent by providing a symmetrical plastic bobbin of unitary construction and simple configuration having a main winding space for winding electrical wire and two terminal winding spaces for forming the terminal connections for the main winding space. The main winding space is separated from the terminal winding spaces by flanges, each flange having one or more notches formed therein for running the winding wire between the terminal winding spaces and the main winding space. The winding wire may thus be wound in a continuous manner on the main winding space and the two terminal winding spaces. Lips are formed at each terminal end of the bobbin to retain the wire wound in the terminal winding spaces.

After winding of wire on the bobbin, each wire wound terminal winding space is immersed in molten solder to completely strip the insulation from the wire and completely solder together the wire turns wound on the terminal winding spaces. The coil thus formed has strong, durable terminal connections which render feasible the automated assembly of the coil into completed devices such as reed relays.

DESCRIPTION OF THE DRAWINGS

A more complete understanding of the present invention and the attendant advantages and features thereof will be more readily appreciated as the same becomes better understood by reference to the following detailed description when considered in conjunction with the accompanying drawings wherein:

FIG. 1 is a perspective view of one embodiment of a bobbin according to the present invention;

FIG. 2A is an end view of another embodiment of the present invention wherein each flange has two notches formed therein in symmetric relation;

FIG. 2B is an end view of yet another embodiment of the present invention wherein each flange has four notches formed therein in symmetric relation;

FIG. 3 is an elevation view of a reed switch mounted within the wound bobbin of FIG. 1, and positioned on a relay lead frame; and FIG. 4 is a perspective view of the embodiment of FIG. 1 provided with a main coil tap terminal connection.

DETAILED DESCRIPTION OF THE PREFERRED EMBODIMENT

Referring now to the drawings, wherein like reference numerals designate similar or corresponding elements throughout the several views, there is shown generally in FIG. 1 a tubular bobbin 10 according to the present invention. The bobbin 10 is an integral unit which is longitudinally symmetrical about the midpoint thereof. The bobbin 10 is formed from any high strength plastic material, high strength plastic material as used herein connotating any plastic material which is capable of withstanding a temperature of approximately 380° C.

without experiencing any melting or plastic deformation. It is to be understood that plastic material as used herein encompasses any dielectric or insulating material or element which can be molded or shaped to form the bobbin 10.

Spaced inwardly from terminal ends of the bobbin 10 are flanges 12. The flanges 12 define therebetween that segment of the bobbin 10 comprising the main coil winding space 14.

Each flange 12 has at least one notch 20 formed therein to provide a passageway between the main coil winding space 14 and the adjacent terminal winding space 18. FIGS. 2A and 2B, respectively, depict other embodiments of the present invention wherein two and four notches 20 are formed in each flange 12 in symmetric relation. The bobbin 10 of these embodiments is completely symmetrical, being symmetrical about the midpoint of the bobbin 10 as well as with respect to a plane passing through the longitudinal axis thereof.

Slightly raised lips or ridges 16 are formed at each terminal end of the body of bobbin 10, being raised sufficiently to retain electrical wire to be wound on the bobbin 10. Terminal winding spaces 18 are thereby defined at each end of the bobbin 10 by a corresponding flange 12 and lip 16.

During winding of the bobbin 10 with electrical wire, a few turns are initially wound on one of the terminal winding spaces 18. The wire is then led to the main coil winding space 14 normally through a notch 20 in the flange 12 adjacent to the wire-wound terminal winding space 18. Once the main coil winding space 14 has been wound with a required number of turns to form the main coil, the wire is led off to the other terminal winding space 18 via a notch 20 in the flange 12 adjacent the unwound terminal winding space 18. The unwound terminal winding space 18 is then extensibly wound with a few turns of the electrical wire, which is then severed. The symmetrical nature of the bobbin 10 greatly facilitates the use of automated wire-winding apparatus to form the main coil and terminal windings.

After the bobbin 10 is wound with wire, each terminal winding space 18 is immersed in molten solder at a temperature of about 200° C. to about 380° C. depending upon the melting temperature of the insulation of the wire wound upon the terminal winding space 18. The wire wound on the terminal winding space 18 when immersed in molten solder is completely stripped of its wire insulation and the stripped wire turns are completely soldered together by means of the molten solder. Since the temperature of the molten solder is less than the melting point of the high strength plastic forming the bobbin 10, no melting or plastic deformation of the bobbin 10 occurs during immersion.

The wires, having been completely soldered together on the terminal winding spaces 18, form a circumferential band of unitary structure which is very strong and durable. The strength and durability of the terminal connections is further enhanced because the completely soldered-together wires of the terminal winding spaces 18 are totally supported on the physically contiguous portions of the bobbin 10 comprising the terminal winding spaces 18.

While the first and second terminal connections of the present invention have been described hereinabove as being formed by dip or immersion soldering of the electrical wire wrapped about the terminal winding spaces 18, the complete soldering together of these wires to form the circumferential band of unitary structure can be effected by other means. For example the electrical wire wrapped about the terminal winding spaces 18 can be circumferentially exposed to thermal energy by means of a soldering iron or open flame so that all wire insulation is stripped therefrom and the metallic wires fused together to form the circumferential band of unitary structure.

Other advantages of the bobbin as herein described are further illustrated by its use in an automatic process for the manufacture of miniature reed relays.

A wire-wound bobbin according to the embodiment of FIG. 1 is shown at 22 in FIG. 3, positioned in a lead frame 24. A reed switch (not shown) is mounted within the bobbin 22 and has lead-in terminals 26 which project axially of the bobbin 22. It will be appreciated by those skilled in the art that when the coil of the bobbin 22 is energized, the reed switch will be actuated.

The construction of the bobbin 22 facilitates ease of mounting to the lead frame 24 by automated techniques. The immersion soldered terminal connections are circumferentially symmetrical and may be positioned in any rotary position about its axis to rest on upturned tags 28 of the frame 24. Thus, no rotary positioning of the bobbin is necessary during assembly of the reed relay.

The leads 26 of the reed switch also rest on upturned tags 30 of the lead frame 24. The spacing between the tags 28 is such that the terminal winding spaces 18 abut the upturned tags 28 and positionally stabilize the reed relay while connections to tags 28 and 30 are quickly made by automated soldering or welding apparatus.

It will be readily appreciated that, because the immersion soldered terminal connections are completely symmetrical and uniformly soldered about the circumference of the bobbin, the wire-wound bobbin 22 is readily positioned on and attachable to the lead frame 24.

The efficacy of the bobbin construction as described with reference to FIGS. 1, 2A or 2B will be readily apparent in that, first, winding of the bobbin and formation of the terminal connections can be carried out entirely by automation to produce very strong and durable terminal connections, and second, the wire-wound bobbin can be easily and readily positioned and connected to a lead frame 24 entirely on an automated basis.

The embodiment shown in FIG. 4 is the same as that of FIGS. 1, 2A or 2B with the addition of a winding former 32 positioned on the main coil winding space 14. The winding former 32 constitutes a disc 34 formed on the main coil winding space 14 having an annular groove 36 formed in the periphery thereof medial the opposed edges of the disc 34. Slots 38 are formed in the peripheral walls of the disc 34 to provide a passageway between the annular groove 36 and each portion of the main coil winding space 14. The slots 38 are formed in the disc 34 in the same manner as the notches 20 formed in the flanges 12, as described herein above.

During winding of the main coil winding space 14, wire is passed through one slot 38 and a number of turns are wound around the annular groove 36. The wire is then passed through another slot 38 and winding of the main tubular winding core 14 continues. The wire wound on the winding former 32 provides accessible positions for forming a terminal connection by soldering to the wire wound in the annular groove 36. It will be appreciated that the winding former 32 provides means for forming a readily accessible tap for the main coil of the bobbin 10.

Obviously, numerous modifications and variations of the present invention are possible in light of the above teachings. It is therefore to be understood that within the scope of the appended claims, the present invention may be practiced otherwise then as specifically described herein above.

What is claimed is:

1. An electrical coil comprising:

a symmetrical high-strength plastic bobbin;

first and second lips integrally formed at ends of said bobbin;

first and second spaced apart flanges integrally formed on said bobbin inwardly of said first and second lips, respectively, said first and second spaced apart flanges defining therebetween a main coil winding space, and said first and second lips and corresponding ones of said first and second spaced apart flanges defining therebetween first and second terminal winding spaces, respectively;

a main coil having a predetermined number of turns of electrical wire around said main coil winding space; and first and second terminal connections having a predetermined number of turns of said electrical wire around each of said first and second terminal winding spaces, said turns being completely soldered together to provide a unitary circumferential band for terminal connection.

2. The electrical coil according to claim 1 wherein each of said first and second spaced apart flanges have at least one notch formed therein defining a wire passageway between said main coil winding space and said first and second terminal winding spaces.

3. The electrical coil according to claim 1 wherein said bobbin has a hollow interior.

4. The electrical coil according to claim 3 further comprising a reed switch disposed through said hollow interior and within said main coil.

5. The electrical coil according to claim 4 further comprising a lead frame having a first pair of terminals adapted to electrically contact corresponding ones of said first and second terminal connections, and a second pair of terminals adapted to electrically contact corresponding terminals of said reed switch.

6. The electrical coil according to claim 1 further comprising a disc integrally formed on said bobbin between said first and second spaced apart flanges to divide said main coil, said disc having an annular winding space wherein a preselected number of turns of said electrical wire are wound to provide a tap for said main coil.

7. The electrical coil according to claim 6 wherein said disc has openings formed in the periphery thereof to define wire passageways between said main coil as divided and said annular winding space.

8. A method for forming an electrical coil, comprising:

forming a bobbin having first and second lips integrally at respective ends thereof and first and second spaced apart flanges formed inwardly from said first and second lips, respectively, said first and second spaced apart flanges defining therebetween a main coil winding space and corresponding ones of said first and second lips and said first and second spaced apart flanges defining therebetween first and second terminal winding spaces, respectively;

winding a preselected number of turns of electrical wire around one of said first and second terminal winding spaces;

winding a preselected number of turns of said wire around said main coil winding space to form a main coil;

winding a preselected number of turns of said wire around the other of said first and second terminal winding spaces;

immersing the one wire-wound terminal winding space in molten solder to completely join together the electrical wire wound thereon to form a first immersion soldered terminal connection for said main coil; and immersing the other wire-wound terminal winding space in molten solder to completely join together the electrical wire wound thereon to form a second immersion soldered terminal connection for said main coil.

9. The method according to claim 8 wherein forming said bobbin further includes forming an integral thick flange having an annular groove formed in the periphery thereof integral with said bobbin between said first and second spaced apart flanges, and wherein winding said main winding space further comprises winding a preselected number of turns of said wire between said one of said first and second spaced apart flanges and said thick flange, winding a preselected number of turns of said wire in said annular groove, and winding a preselected number of turns of said wire between said thick flange and said other of said first and second spaced apart flanges, thereby providing a tap for said main coil.

10. The method of claim 8, wherein said bobbin forming step further includes forming a bobbin having a hollow interior, and further comprising steps of disposing a reed switch having end terminals in said hollow interior in alignment with said main coil and such that said end terminals extend from corresponding ends of said interior of said bobbin, connecting said immersion soldered first and second terminal connections to corresponding ones of a second pair of electrical terminals of a lead frame, and electrically connecting said end terminals of said reed switch to corresponding ones of a first pair of electrical terminals of said lead frame.

11. The electrical coil according to claim 1 wherein each said turns of said electrical wire are completely soldered together by immersing said turns in molten solder.

12. The electrical coil according to claim 1 wherein each said turns of said electrical wire are completely soldered together by circumferentially exposing said turns to thermal energy so that insulation circumscribing said electrical wire is stripped therefrom and metallic wire forming said turns is fused together.

* * * * *